US008395038B2

(12) United States Patent
Smith

(10) Patent No.: US 8,395,038 B2
(45) Date of Patent: Mar. 12, 2013

(54) PICK FOR AN INSTRUMENT

(76) Inventor: Jeff D. Smith, Warren, MI (US)

( * ) Notice: Subject to any disclaimer, the term of this patent is extended or adjusted under 35 U.S.C. 154(b) by 0 days.

(21) Appl. No.: 13/011,489

(22) Filed: Jan. 21, 2011

(65) Prior Publication Data

US 2011/0179938 A1 Jul. 28, 2011

Related U.S. Application Data

(60) Provisional application No. 61/297,385, filed on Jan. 22, 2010, provisional application No. 61/346,936, filed on May 21, 2010.

(51) Int. Cl.
*G10D 3/16* (2006.01)

(52) U.S. Cl. ..... 84/322

(58) Field of Classification Search ..... 84/322
See application file for complete search history.

(56) References Cited

U.S. PATENT DOCUMENTS

| | | | | | |
|---|---|---|---|---|---|
| 3,181,410 | A | | 5/1965 | Phillips | |
| 4,015,502 | A | * | 4/1977 | Strong | 84/322 |
| 4,064,781 | A | | 12/1977 | Fals | |
| 5,610,349 | A | | 3/1997 | Fogarty et al. | |
| 5,894,097 | A | * | 4/1999 | Barry | 84/322 |
| 5,942,704 | A | * | 8/1999 | Weldon | 84/320 |
| 6,008,442 | A | | 12/1999 | Reidenbach | |
| 6,130,374 | A | | 10/2000 | Polidori | |
| 6,133,516 | A | * | 10/2000 | Hendrickson | 84/322 |
| 2008/0163737 | A1 | | 7/2008 | Grant | |

* cited by examiner

*Primary Examiner* — Christopher Uhlir
(74) *Attorney, Agent, or Firm* — Howard & Howard Attorneys PLLC

(57) ABSTRACT

The present invention provides for a pick for an instrument having a string. The pick includes a body formed of a first material and having an outer periphery. The pick further includes a tip extending from the outer periphery of the body for engaging the string of the instrument. The tip is formed of a second material different from the first material of the body.

16 Claims, 1 Drawing Sheet

PICK FOR AN INSTRUMENT

CROSS REFERENCE TO RELATED APPLICATIONS

This application claims the benefit of U.S. Provisional Patent Application Ser. No. 61/297,385, filed on Jan. 22, 2010 and U.S. Provisional Patent Application Ser. No. 61/346,936, filed on May 21, 2010, the disclosures of which are hereby incorporated by reference in their entirety.

BACKGROUND OF THE INVENTION

1. Field of the Invention

The present invention generally relates to a pick for an instrument having a string.

2. Description of the Related Art

Picks for engaging strings of an instrument to produce sound are known in the art. Picks are used for various instruments such as guitars.

One type of pick is completely formed of a plastic material. Plastic picks produce good sound quality and flexure but wear quickly. For example, plastic picks become notched or break and must be thrown out.

Another type of pick is completely formed of a metal material which reduces wear such as notching or breaking. However, metal picks are known to have poorer sound quality and flexure than plastic picks and also feel awkward in a user's fingers.

Therefore, there remains an opportunity to develop a pick that produces good sound quality while also increasing the life of the pick.

SUMMARY OF THE INVENTION AND ADVANTAGES

The present invention provides for a pick for an instrument having a string. The pick includes a body formed of a first material and having an outer periphery. The pick further includes a tip extending from the outer periphery of the body for engaging the string of the instrument. The tip is formed of a second material different from the first material of the body.

The pick therefore provides for good sound quality when engaging the string of the instrument. In addition, the body allows for good flexure and grip while the tip reduces wear to increase the life of the pick.

BRIEF DESCRIPTION OF THE DRAWINGS

Advantages of the present invention will be readily appreciated, as the same becomes better understood by reference to the following detailed description, when considered in connection with the accompanying drawings.

DETAILED DESCRIPTION OF THE INVENTION

Figure 1:
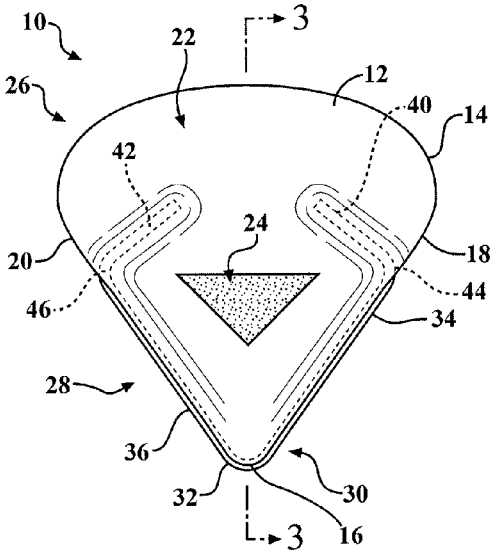
FIG. 1 is a plan view of a pick.

Referring to the Figures, wherein like numerals indicate like or corresponding parts throughout the several views, a pick 10 for an instrument (not shown) having a string (not shown) is generally shown in FIG. 1. It is to be appreciated that the string can be further defined as a plurality of strings. The instrument can be defined as a guitar, a banjo, a ukulele, or any other instrument that utilizes the pick 10 to engage the string(s) to produce sound.

The pick 10 includes a body 12 having an outer periphery 14. The outer periphery 14 of the body 12 includes a distal edge 16, a first edge 18 adjacent the distal edge 16, and a second edge 20 adjacent the distal edge 16 spaced from the first edge 18. Hence, the distal edge 16, the first edge 18, and the second edge 20 define a generally V-shaped configuration. It is to be appreciated that the distal edge 16, the first edge 18, and the second edge 20 can cooperate to define any other suitable configuration, such as circular, square, rectangular, etc. or a combination thereof. Further, it is to be appreciated that the distal edge 16 can be substantially planar or any other suitable configuration.

In addition, the body 12 includes an exterior surface 22 adjacent the outer periphery 14 for griping the pick 10. Optionally, the body 12 can include a textured surface 24 disposed on the exterior surface 22 for aiding in griping the pick 10. The textured surface 24 can extend outwardly from the exterior surface 22 and/or be recessed in the exterior surface 22. It is to be appreciated that the textured surface 24 can be utilized with any of the embodiments discussed herein.

The body 12 includes an upper portion 26 and a lower portion 28 abutting each other with the upper portion 26 tapering toward the lower portion 28. The lower portion 28 also tapers as the lower portion 28 extends away from the upper portion 26. Hence, as the upper portion 26 tapers toward the lower portion 28, the first and second edges 18, 20 of the outer periphery 14 extend toward each other to define the generally V-shaped configuration. The upper and lower portions 26, 28 cooperate to define a generally triangular configuration for gripping the pick 10. It is to be appreciated that the upper and lower portions 26, 28 of the body 12 can cooperate to define any other suitable configuration, such as circular, square, rectangular, etc. or a combination thereof, for gripping the pick 10.

The body 12 is formed of a first material. The first material is further defined as a polymeric material. For example, the polymeric material can be further defined as plastic. By forming the body 12 with polymeric material, the pick 10 can flex or bend thus providing a more comfortable feel to a user while utilizing the pick 10. In addition, by forming the body 12 with polymeric material, the pick 10 will provide good sound quality. It is to be appreciated that the first material can be any suitable material for providing good flexure and grip of the body 12, as well as good sound quality.

The pick 10 further includes a tip 30 extending from the outer periphery 14 of the body 12 for engaging the string of the instrument. More specifically, the tip 30 extends from the distal edge 16 of the outer periphery 14 for engaging the string of the instrument. Hence, the tip 30 engages the string(s) of the instrument to produce sound. Typically, the first material covers a portion of the tip 30 for securing the tip 30 to the body 12. It is to be appreciated that the first material can encapsulate the portion of the tip 30 for securing the tip 30 to the body 12.

The tip 30 includes a distal end 32 extending beyond the distal edge 16 of the outer periphery 14 for engaging the string. Typically, a portion of the distal end 32 of the tip 30 is spaced from the first material of the body 12. In other words, typically, the portion of the distal end 32 of the tip 30 is free of the first material of the body 12 for engaging the string of the instrument. It is to be appreciated that the distal end 32 of the tip 30 can be substantially or entirely free of the first material of the body 12. Further, it is to be appreciated that the first material can cover or encapsulate a portion of the distal end 32. In addition, it is to be appreciated that the outer periphery 14, and more specifically the distal edge 16, of the body 12 can abut the distal end 32 of the tip 30 such that the distal end 32 engages the string of the instrument.

In certain embodiments, the distal end 32 of the tip 30 defines an arcuate configuration. It is to be appreciated that the distal end 32 of the tip 30 can be any suitable configuration for engaging the string of the instrument.

The tip 30 further includes a first leg 34 extending along the first edge 18 and a second leg 36 extending along the second edge 20. The first and second legs 34, 36 are spaced from each other and each extend from the distal end 32 to define a generally V-shaped configuration. It is to be appreciated that the distal end 32, the first leg 34, and the second leg 36 can cooperate to define any other suitable configuration, such as circular, square, rectangular, etc. or a combination thereof.

The first material can cover or encapsulate at least a portion of the first and second legs 34, 36 for securing the tip 30 to the body 12. It is to be appreciated that the first material can substantially or entirely cover or encapsulate the first and second legs 34, 36. Further, it is to be appreciated that the first and second legs 34, 36 can be substantially or entirely free of the first material of the body 12. It is to be appreciated that the distal edge 16, the distal end 32, and the first and second legs 34, 36 can define an opening therebetween.

The tip 30 also includes a first finger 40 extending from the first leg 34 inwardly away from the first edge 18 and a second finger 42 extending from the second leg 36 inwardly away from the second edge 20. In other words, the first and second fingers 40, 42 extend generally toward each other and terminate in a spaced relationship. Typically, the first material covers or encapsulates the first and second fingers 40, 42 for securing the tip 30 to the body 12. It is to be appreciated that the first material can substantially or entirely cover or encapsulate the first and second fingers 40, 42. Further, it is to further be appreciated that the first material can cover or encapsulate a portion of at least one of the first and/or second fingers 40, 42.

The tip 30 further includes a first corner 44 disposed between the first leg 34 and the first finger 40 and a second corner 46 disposed between the second leg 36 and the second finger 42. The first and second corners 44, 46 can define an arcuate configuration. It is to be appreciated that the first and second corners 44, 46 can be any suitable configuration. Typically, the first material covers or encapsulates the first and second corners 44, 46 for securing the tip 30 to the body 12. It is to be appreciated that the first material can substantially or entirely cover or encapsulate the first and second corners 44, 46. Further, it is to be appreciated that the first material can cover or encapsulate a portion of at least one of the first and/or second corners 44, 46. In addition, it is to be appreciated that the first and second corners 44, 46 can be substantially or entirely free of the first material of the body 12.

The tip 30 is formed of a second material different from the first material of the body 12. More specifically, the second material is further defined as a metal material. The metal material is further defined as brass, steel, copper, aluminum and/or any other suitable metal material(s). It is to be appreciated that the second material of the tip 30 provides more rigid physical characteristics than the first material of the body 12. Typically, the second material reduces wear of the pick 10, and more specifically the tip 30, to increase the life of the pick 10. Further, by only forming the tip 30 of the second material, there is less adverse affects to the sound quality of the pick 10 and the flexure/grip of the pick 10 is maintained.

In certain embodiments, the tip 30 is further defined as a wire, such as a metallic wire, etc. The wire is formed or bent to a configuration corresponding to the desired overall configuration or dimensions of the tip 30. The wire can also define a cross-section of any suitable configuration, such as circular, triangular, square, etc. or a combination thereof for engaging the string of the instrument to produce sound. The tip 30 or wire can be any suitable thickness $t_1$ or diameter. For example, the thickness $t_1$ or diameter of the tip 30 can be defined as of from about 0.031 inches. As another example, the thickness $t_1$ of the tip 30 can be defined as of from about 0.035 to 0.040 inches. As yet another example, the thickness $t_1$ of the tip 30 can be defined as of from about 0.055 to 0.065 inches. As another example, the thickness $t_1$ of the tip 30 can be defined as of from about 0.055 to 0.060 inches. It is to be appreciated that the thickness $t_1$ of the tip 30 can be defined as of from about 0.080 inches. Further, it is to be appreciated that the thickness $t_1$ of the tip 30 can be defined as greater than 0.080 inches or less than 0.031 inches. In addition, it is to be appreciated that the tip 30 can define more than one thickness $t_1$.

Figure 2:
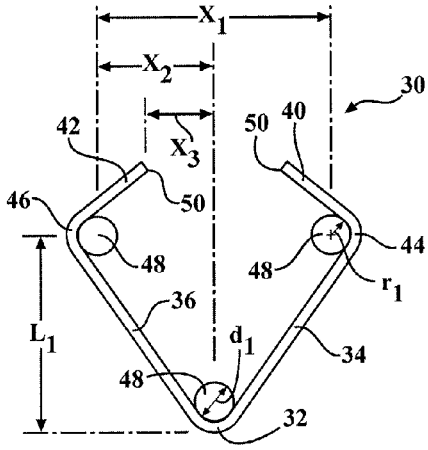
FIG. 2 is a plan view of a tip for the pick illustrated in FIG. 1.

For example, as shown in FIG. 2, a pin 48 or shape is utilized to form the distal end 32 and the first and second corners 44, 46 to a desired configuration. More specifically, the pin 48 is utilized to form the arcuate configuration of the distal end 32 and the arcuate configuration of the first and second corners 44, 46. Typically, the tip 30 is formed by bending the wire about the pin 48 or shape. The pin 48 can define any suitable diameter $d_1$ for forming the distal end 32 and the first and second corners 44, 46. For example, the diameter $d_1$ of the pin 48 can be defined as of from about 3.58 millimeters. Further, the pin 48 can define any suitable radius $r_1$ for forming the distal end 32 and the first and second corners 44, 46. For example, the radius $r_1$ of the pin 48 can define the radius $r_1$ of from about 1.79 millimeters.

Further, the distal end 32, the first corner 44, and the second corner 46 can define any suitable radius. Typically, the radius of the distal end 32, the first corner 44, and the second corner 46 is complementary to the diameter $d_1$/radius $r_1$ of the pin 48.

It is to be appreciated that a plurality of pins 48 or shapes can be utilized to form the tip 30. For example, the diameter $d_1$/radius $r_1$ of each of the pins 48 can be equal to each other. As another example, the diameter $d_1$/radius $r_1$ of one of the pins 48 can be different from the diameter $d_1$/radius $r_1$ of the other pins 48. As yet another example, the diameter $d_1$/radius $r_1$ of each of the pins 48 can be different from each other. It is to be appreciated that the pins 48/shapes can be the same or different from each other, etc.

In addition, the first and second legs 34, 36 can define any suitable length $L_1$. For example, from center of the pin 48 for the distal end 32 to center of the pin 48 for either the first or second legs 34, 36 can define the length $L_1$ of from about 14.645 millimeters. Further, the first and second corners 44, 46 can define any suitable distance $X_1$ therebetween. For example, from center of the pin 48 for the first corner 44 to center of the pin 48 for the second corner 46 can define the distance $X_1$ of from about 20.13 millimeters. Also, the distal end 32 and one of the first and second corners 44, 46 can define any suitable distance $X_2$ therebetween. For example, from center of the pin 48 for the distal end 32 to center of the pin 48 for either the first or second corners 44, 46 can define the distance $X_2$ of from about 10.065 millimeters. Additionally, the distal end 32 and an end 50 of either the first or second fingers 40, 42 can define a distance $X_3$ therebetween. For example, from center of the pin 48 for the distal end 32 to the end 50 of either the first or second fingers 40, 42 can define the distance $X_3$ of from about 5.76 millimeters.

Figure 3:
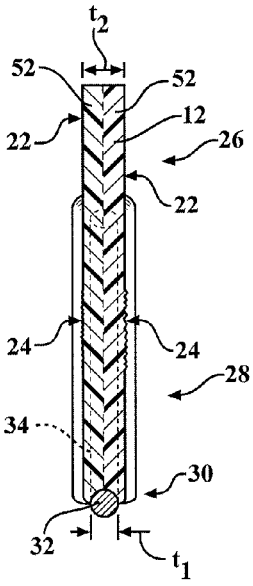
FIG. 3 is a cross-sectional view of the pick taken from lines 3-3 of FIG. 1.
Figure 4:
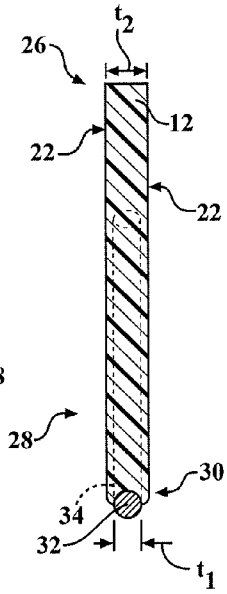
FIG. 4 is a cross-sectional view of the pick formed by injection molding.

The body 12 can define any suitable thickness $t_2$. For example, the thickness $t_2$ of the body 12 can be substantially the same such that the portion of the tip 30 disposed in the body 12 causes the first material to protrude as shown in FIGS. 1 and 3. As another example, the thickness $t_2$ of the body 12 can change such that the exterior surface 22 of the body 12 appears substantially planar or flat as shown in FIG. 4. As yet another example, the thickness $t_2$ of the body 12 can be defined as of from about 0.035 to 0.040 inches. As another example, the thickness $t_2$ of the body 12 can be defined as of from about 0.055 to 0.065 inches. As yet another example, the thickness $t_2$ of the body 12 can be defined as of from about 0.055 to 0.060 inches. It is to be appreciated that the thickness $t_2$ of the body 12 can be defined as of from about 0.080 inches. It is to be appreciated that the thickness $t_2$ of the body 12 can be defined as greater than 0.080 inches or less than 0.035 inches. Further, it is to be appreciated that the body 12 can define more than one thickness $t_2$. In addition, it is to be appreciated that the thickness $t_1$ of the tip 30 can be equal to, less than, or greater than the thickness $t_2$ of the body 12.

Figure 5:
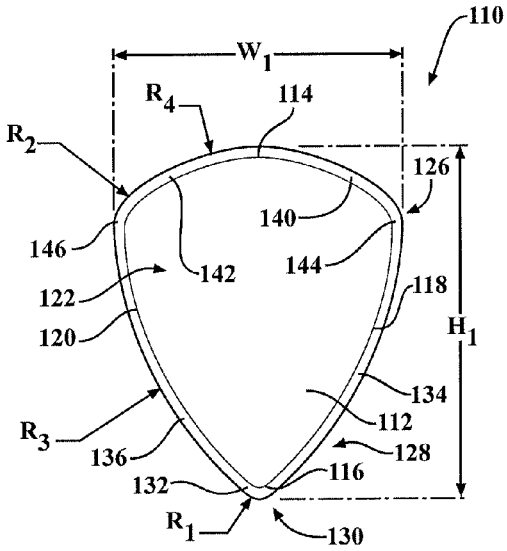
FIG. 5 is a plan view of a pick of another embodiment.

As shown in FIG. 5, another embodiment of a pick 110 is generally shown. The pick 110 includes a body 112 having an outer periphery 114. The outer periphery 114 of the body 112 includes a distal edge 116, a first edge 118 adjacent the distal edge 116, and a second edge 120 adjacent the distal edge 116 spaced from the first edge 118. Hence, the distal edge 116, the first edge 118, and the second edge 120 define a generally V-shaped configuration. It is to be appreciated that the distal edge 116, the first edge 118, and the second edge 120 can cooperate to define any other suitable configuration, such as circular, square, rectangular, etc. or a combination thereof. The body 112 is formed of a first or polymeric material as discussed above.

The body 112 includes an upper portion 126 and a lower portion 128 abutting each other with the upper portion 126 tapering toward the lower portion 128. The lower portion 128 also tapers as the lower portion 128 extends away from the upper portion 126. The upper and lower portions 126, 128 cooperate to define a generally triangular configuration for gripping the pick 110. It is to be appreciated that the upper and lower portions 126, 128 of the body 112 can cooperate to define any other suitable configuration, such as circular, square, rectangular, etc. or a combination thereof, for gripping the pick 110. The body 112 can be any suitable thickness. For example, the thickness of the body 112 can be defined as of from about 1.0 millimeters. As another example, the body 112 can be defined as any of the thicknesses $t_2$ discussed above for the body 12. It is to be appreciated that the body 112 can define more than one thickness.

The pick 110 further includes a tip 130 extending from the outer periphery 114 and entirely surrounding the body 112. More specifically, the tip 130 includes a distal end 132 extending beyond the outer periphery 114 of the body 112. The tip 130 is formed of a second or metal material as discussed above.

The tip 130 further includes a first leg 134 extending along the first edge 118 and a second leg 136 extending along the second edge 120. The first and second legs 134, 136 are spaced from each other and each extend from the distal end 132 to define a generally V-shaped configuration. It is to be appreciated that the distal end 132, the first leg 134, and the second leg 136 can cooperate to define any other suitable configuration, such as circular, square, rectangular, etc. or a combination thereof.

The tip 130 also includes a first finger 140 extending from the first leg 134 inwardly away from the first edge 118 and a second finger 142 extending from the second leg 136 inwardly away from the second edge 120. In other words, the first and second fingers 140, 142 extend generally toward each other and engage each other. Hence, the distal end 132, the first leg 134, the second leg 136, the first finger 140, and the second finger 142 cooperate to define a generally triangular configuration complementary to the body 112.

The tip 130 further includes a first corner 144 disposed between the first leg 134 and the first finger 140 and a second corner 146 disposed between the second leg 136 and the second finger 142. The first and second corners 144, 146 can define an arcuate configuration. It is to be appreciated that the first and second corners 144, 146 can be any suitable configuration. Hence, the distal end 132, the first and second legs 134, 136, the first and second fingers 140, 142, and the first and second corners 144, 146 encircle the body 112. In other words, the distal end 132, the first and second legs 134, 136, the first and second fingers 140, 142, and the first and second corners 144, 146 extend beyond the body 112 and more specifically the outer periphery 114. The first and second fingers 140, 142 are disposed adjacent the upper portion 126 and the distal end 132 is disposed adjacent the lower portion 128 and additionally, the first and second legs 134, 136 are disposed adjacent both the upper and lower portions 126, 128.

In this embodiment, the tip 130 defines a configuration complementary to the configuration of the body 112. For example, if a generally triangular configuration of the pick 110 is desired, the body 112 and the tip 130 generally follow the same configuration due to the tip 130 extending from the outer periphery 114 of the body 112. It is to be appreciated that the tip 130 can define a configuration different from the configuration of the body 112.

Typically, the tip 130 of this embodiment is further defined as a wire such as a metallic wire, etc. The wire is formed or bent to a configuration corresponding to the desired overall configuration or dimensions of the pick 110. The wire can also define a cross-section of any suitable configuration, such as circular, triangular, square, etc. or a combination thereof for engaging the string of the instrument to produce sound. The tip 130 or wire can be any suitable thickness. For example, the thickness of the tip 130 can be defined as of from about 1.0 millimeters. As another example, the tip 130 can be defined as any of the thicknesses $t_1$ discussed above for the tip 30. It is to be appreciated that the tip 130 can define more than one thickness. Further, it is to be appreciated that the thickness of the tip 130 can be equal to, less than, or greater than the thickness of the body 112.

The distal end 132 can define any suitable radius $R_1$, the first and second corners 144, 146 can each define any suitable radius $R_2$, the first and second legs 134, 136 can each define any suitable radius $R_3$, and the first and second fingers 140, 142 can each define any suitable radius $R_4$. For example, the radius $R_1$ of the distal end 132 can be defined as of from about 1.8 millimeters, the radius $R_2$ of the first and second corners 144, 146 can each be defined as of from about 4.2 millimeters, the radius $R_3$ of the first and second legs 134, 136 can each be defined as of from about 33.6 millimeters, and the radius $R_4$ of the first and second fingers 140, 142 can each be defined as of from about 24.0 millimeters. In addition, the pick 110 can define any suitable height $H_1$ and any suitable width $W_1$. For example, the height $H_1$ of the pick 110 can be defined as of from about 31.2 millimeters and the width of the pick 110 can be defined as of from about 26.3 millimeters.

For any of these embodiments, the pick 10, 110 is formed by any suitable manufacturing process, such as injection molding, laminating, vacuum forming etc. As one example, as shown in FIG. 3, once the tip 30 or wire is formed to a desired configuration, at least one sheet 52 of polymeric material is laminated to the tip 30 to form the body 12 and thus the pick 10. More specifically, typically, a plurality of sheets 52 of polymeric material are laminated to the tip 30 to form the body 12 and thus the pick 10. Hence, the tip 30 is secured to the body 12 such that the distal end 32 of the tip 30 extends from the outer periphery 14 of the body 12. In other words, the tip 30 is secured to the body 12 such that the distal end 32 extends beyond the distal edge 16 of the outer periphery 14. It is to be appreciated that one or more sheet(s) 52 can be utilized to form the pick 10 by vacuum forming.

As another example, as shown in FIG. 4, once the tip 30 is formed to a desired configuration, the polymeric material of the body 12 is injection molded over at least a portion of the first and second fingers 40, 42 of the tip 30, at least a portion of the first and second legs 34, 36 of the tip 30, and/or a portion of the distal end 32 of the tip 30 to form the body 12 and thus the pick 10. Hence, the tip 30 is secured to the body 12 such that the distal end 32 of the tip 30 extends from the outer periphery 14 of the body 12. In other words, the tip 30 is secured to the body 12 such that the distal end 32 extends beyond the distal edge 16 of the outer periphery 14.

As yet another example, as shown in FIG. 5, once the tip 130 is formed to a desired configuration, the polymeric material of the body 112 is injection molded, vacuum formed, laminated, etc., within the tip 130 to form the body 112 and thus the pick 110. For vacuum forming or laminating the pick 110 for the embodiment of FIG. 5, one or more sheet(s) 52 of polymeric material of the body 112 is secured to a portion of the tip 130 to form the pick 110. As such, the first material/polymeric material of the body 112 can cover or encapsulate at least a portion of the first and second fingers 140, 142 of the tip 130, at least a portion of the first and second legs 134, 136 of the tip 130, and/or a portion of the distal end 132 of the tip 130 to form the body 112 and thus the pick 110. Hence, the tip 130 is secured to the body 112 such that the distal end 132 of the tip 130 extends from the outer periphery 114 of the body 112. In other words, the tip 130 is secured to the body 112 such that the distal end 132 extends beyond the distal edge 116 of the outer periphery 114.

Many modifications and variations of the present invention are possible in light of the above teachings. The foregoing invention has been described in accordance with the relevant legal standards; thus, the description is exemplary rather than limiting in nature. Variations and modifications to the disclosed embodiment can become apparent to those skilled in the art and do come within the scope of the invention. Accordingly, the scope of legal protection afforded this invention can only be determined by studying the following claims.

What is claimed is:

1. A pick for an instrument having a string, said pick comprising:

a body formed of a first material and having an outer periphery, said body defining a sheet of said first material having a substantially planar configuration;

a tip extending around said outer periphery of said body for engaging the string of the instrument; and said tip formed of a second material different from said first material of said body changing a physical and acoustical quality of said body where the tip provides a different physical and acoustical quality than said body of said pick when said pick engages the string of an instrument, said tip being partially encapsulated by said sheet of material defined by said body for retaining said tip to said body, with said second material of said tip being defined as a wire wherein said wire includes wire segments which extend along a periphery of said body and being only partially encapsulated by said first material along said periphery of said body.

2. A pick as set forth in claim 1 wherein said first material is further defined as a polymeric material.

3. A pick as set forth in claim 2 wherein said polymeric material is further defined as plastic.

4. A pick as set forth in claim 1 wherein said second material is further defined as a metal material.

5. A pick as set forth in claim 4 wherein said metal material is further defined as brass.

6. A pick as set forth in claim 4 wherein said metal material is further defined as steel.

7. A pick as set forth in claim 4 wherein said metal material is further defined as copper.

8. A pick as set forth in claim 4 wherein said metal material is further defined as aluminum.

9. A pick as set forth in claim 1 wherein said outer periphery includes a distal edge, a first edge adjacent said distal edge, and a second edge adjacent said distal edge spaced from said first edge with said tip extending from said distal edge for engaging the string of the instrument.

10. A pick as set forth in claim 9 wherein said tip includes a distal end extending beyond said distal edge of said outer periphery for engaging the string.

11. A pick as set forth in claim 10 wherein said distal end defines an arcuate configuration.

12. A pick as set forth in claim 10 wherein said wire segments include a first leg extending along said first edge and a second leg extending along said second edge with said first and second legs spaced from each other and each extending from said distal end.

13. A pick as set forth in claim 12 wherein said wire segments include a first finger extending from said first leg inwardly away from said first edge and a second finger extending from said second leg inwardly away from said second edge.

14. A pick as set forth in claim 12 wherein said first material covers at least a portion of said first and second legs for securing said tip to said body.

15. A pick as set forth in claim 13 wherein said first material covers said first and second fingers for securing said tip to said body.

16. A pick as set forth in claim 1 wherein said tip extends from said outer periphery entirely surrounding said body.

* * * * *